US012780587B2

(12) United States Patent
Ju

(10) Patent No.: US 12,780,587 B2
(45) Date of Patent: Nov. 3, 2026

(54) TAPE CUTTER

(71) Applicant: Hwanook Ju, Yongin-si (KR)

(72) Inventor: Hwanook Ju, Yongin-si (KR)

( * ) Notice: Subject to any disclaimer, the term of this patent is extended or adjusted under 35 U.S.C. 154(b) by 118 days.

(21) Appl. No.: 18/730,058

(22) PCT Filed: Jan. 6, 2023

(86) PCT No.: PCT/KR2023/000265
§ 371 (c)(1),
(2) Date: Jul. 18, 2024

(87) PCT Pub. No.: WO2023/140545
PCT Pub. Date: Jul. 27, 2023

(65) Prior Publication Data

US 2025/0115451 A1 Apr. 10, 2025

(30) Foreign Application Priority Data

Jan. 18, 2022 (KR) ..... 10-2022-0007205

(51) Int. Cl.
*B65H 35/00* (2006.01)

(52) U.S. Cl.
CPC ..... *B65H 35/0033* (2013.01); *B65H 35/008* (2013.01); *B65H 2301/51541* (2013.01); *B65H 2404/7414* (2013.01); *B65H 2701/377* (2013.01)

(58) Field of Classification Search
CPC ..... B65H 35/0033; B65H 2301/51541; B65H 2404/7414
(Continued)

(56) References Cited

U.S. PATENT DOCUMENTS

2010/0193539 A1* 8/2010 Fathi ..... B65H 35/0026 221/45

FOREIGN PATENT DOCUMENTS

JP 52-152084 U 11/1977
JP 58-137671 U 9/1983
(Continued)

OTHER PUBLICATIONS

Stahl, U., "English machine-translation by Clarivate Analytics of EP1028078A2 with full EP patent application included", B65H35/0026, Jan. 7, 2000. (Year: 2000).*
(Continued)

*Primary Examiner* — Abbas Rashid
*Assistant Examiner* — Gregory C. Grosso
(74) *Attorney, Agent, or Firm* — KORUS Patent, LLC; Seong Il Jeong

(57) ABSTRACT

The present invention relates to a tape cutter and, specifically, to a tape cutter comprising a cutter body from which a roll-type tape accommodated therein is withdrawn to the outside through a withdrawal hole formed in the bottom surface thereof, and which has a blade so that the withdrawn tape can be cut, wherein the cutter body has an adhesion guide member which is provided downwardly at the front side thereof adjacent to the withdrawing hole, so that the tape is withdrawn while the non-adhesive surface thereof comes in contact with the rear thereof, and which is supported, as then rotated forward, and thus the present invention enables an operation to be performed without turning of a box or bending of the arm of an operator when adjacent sides to be adhered, which form a predetermined angle with each other, are taped, and thus can inhibit injury of a user and increase work efficiency.

3 Claims, 8 Drawing Sheets

(58) Field of Classification Search
USPC ..... 156/510
See application file for complete search history.

(56) References Cited

FOREIGN PATENT DOCUMENTS

| | | | |
|---|---|---|---|
| JP | 1-271366 | A | 10/1989 |
| JP | 2004-307218 | A | 11/2004 |
| KR | 10-1700029 | B1 | 1/2017 |

OTHER PUBLICATIONS

Furukawa, T., "English machine-translation by Clarivate Analytics of JPH10330021A with full JP patent application included", B65H35/0033, May 30, 1997. (Year: 1997).*
Furukawa, T., "English machine-translation by Clarivate Analytics of JPH10330021A with full JP patent application included", B65H35/0033, May 30, 1997. (See the NPL document filed on Jan. 14, 2026). (Year: 1997).*
International Search Report dated Apr. 21, 2023 in International Application No. PCT/KR2023/000265.

* cited by examiner

TAPE CUTTER

CROSS-REFERENCE TO RELATED APPLICATIONS

This application is the U.S. national stage application of International Patent Application No. PCT/KR2023/000265, filed Jan. 6, 2023, which claims the benefit under 35 U.S.C. § 119 of Korean Application No. 10-2022-0007205, filed Jan. 18, 2022, the disclosures of each of which are incorporated herein by reference in their entirety.

TECHNICAL FIELD

The present disclosure relates to a tape cutter and, particularly, to a tape cutter making it possible to tape, easily at a time, adjacent surfaces making a predetermined angle of a taping-target object.

RELATED ART

In general, tape is a tool that has an adhesive put on one surface and is used to stick something, and band-shaped tape is wound in a roll shape and is cut to appropriate lengths when they are used. Such tape is manufactured with various widths, depending on the purposes, and, as one of tape that is generally used, there is a box tape that is used to pack boxes.

Products are packed with a box or a bubble wrap before they are delivered by home delivery or mail, and box tape are used in this case. Workers use a knife, scissors, or the like to repeatedly cut box tape to predetermined lengths in packing, but this is troublesome for workers who perform packing as main work. Tape cutters that can be equipped with tape and have a blade that can cut the tape have been proposed to solve this problem.

Meanwhile, when taping up a box, in generally, workers close the open inlet and then tape the surface closing the inlet (the top of the box) and another surface (a side of the box) making a predetermined angle with the closed surface at once. That is, workers attach tape from a side of a box to another side of the box across the top of the box closing the inlet in order to firmly close the box and tape cutters provide only the function of releasing tape accommodated therein to the outside and cutting the attached tape with a blade. However, even though using a tape cutter, workers attach tape while turning a box such that a side, the top, and another side of the box sequentially face up or attach tape while bending an arm with a tape cutter in hand, so there is a problem that workers make excessive movements and work efficiency decreases.

DISCLOSURE

Technical Problem

The present disclosure has been made in an effort to solve the problems described above and an objective of the present disclosure is to provide a tape cutter that can inhibit injuries of a worker and increase work efficiency because a worker can work even without turning a box or bending an arm when taping adjacent taping-target surfaces making a predetermined angle to each other.

Technical Solution

A tape cutter of the present disclosure for achieving the objectives described above includes a cutter body configured to release rolled tape accommodated therein to the outside through a release hole formed on a bottom thereof and configured to be able to cut the released tape by having a blade, in which the cutter body comprises a taping guide disposed downward at a front side adjacent to the release hole, configured to make the tape be released with a non-adhesive surface of the tape in contact with a rear thereof, and configured to rotate forward after holding.

Further, the taping guide may include a rotary shaft disposed in a width direction inside the cutter body, and a taping guide member coupled to rotate with the rotary shaft and disposed downward, a locking protrusion protruding in a direction in which the locking protrusion does not interfere with rotation of the taping guide member may be formed on the rotary shaft, and when a force that rotates forward the taping guide member is applied, the locking protrusion may be elastically locked, and then when a force over a predetermined level is applied, the locking protrusion may be unlocked.

Further, the cutter body may include a holding unit therein configured to elastically lock the locking protrusion, and the holding unit may include a holder disposed such that an end portion thereof is positioned over an end portion of the locking protrusion for elastic holding.

Further, a bottom of the end portion of the holding unit may be configured to be inclined upward toward a rear.

Further, the taping guide may be returned to an initial position by elasticity after rotated forward.

Advantageous Effects

According to the present disclosure, for adjacent taping-target surfaces making a predetermined angle to each other, when the cutter body is moved to move over a second taping-target surface with the taping guide, which is positioned downward, positioned close to a first taping-target surface, the taping guide is held, so tape is attached to the first taping-target surface. Further, as the cutter body keeps being moved, the taping guide is rotated forward, so the tape is attached to the second taping-target surface without interference by the taping guide.

Accordingly, a worker can tape adjacent taping-target surfaces even without turning a taping-target object or bending his/her arm, so it is possible to inhibit injuries of a worker and improve work efficiency.

MODE FOR INVENTION

The present disclosure propose a tape cutter that includes a cutter body configured to release rolled tape accommodated therein to the outside through a release hole formed on a bottom thereof and configured to be able to cut the tape by having a blade, wherein the cutter body comprises a taping guide disposed downward at a front side adjacent to the release hole, configured to make the tape be released with a non-adhesive surface of the tape in contact with a rear thereof, and configured to rotate forward after holding in order to inhibit injuries of a user and improve work efficiency because a worker can work even without turning a box of bending an arm when taping adjacent taping-target surfaces making a predetermined angle to each other.

The right range of the present disclosure is not limited to the following embodiments and the present disclosure may be changed in various ways by those skilled in the art without departing from the scope of the present disclosure.

Hereafter, a tape cutter of the present disclosure is described in detail with reference to FIGS. 1 to 9.

Figure 1:
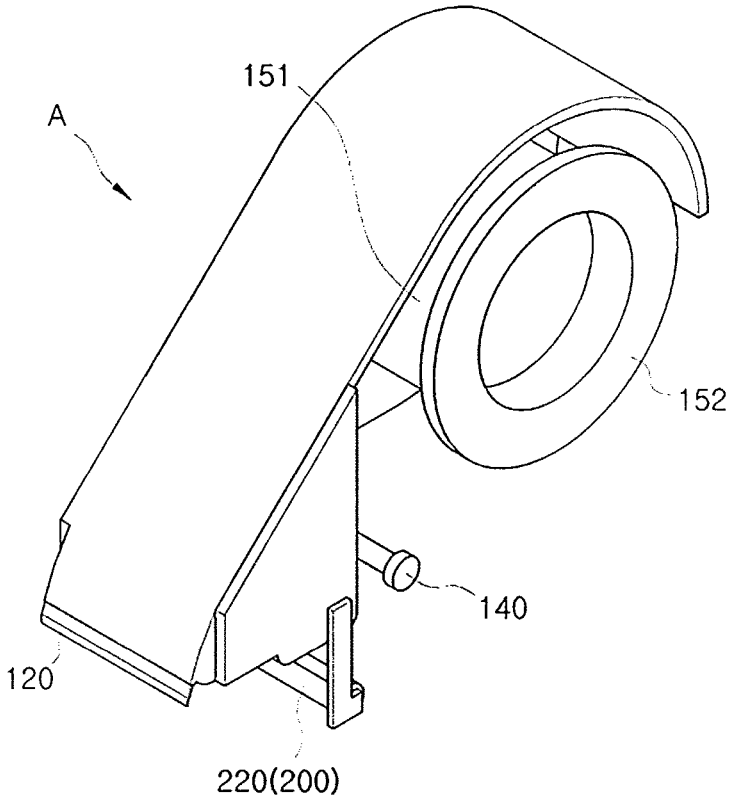
FIGS. 1 and 2 are perspective view showing a tape cutter of the present disclosure.
Figure 2:
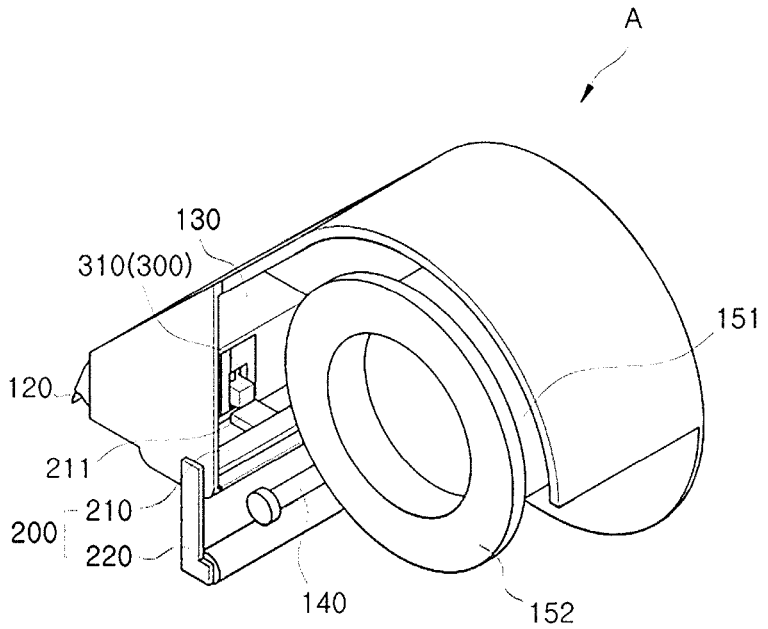
Figure 3:
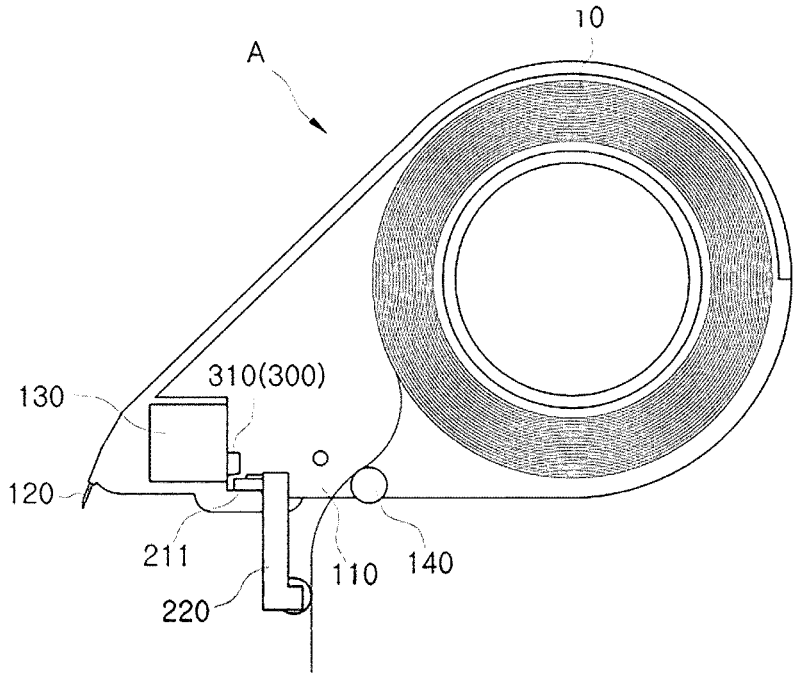
FIG. 3 is a side view showing the tape cutter of the present disclosure.

A tape cutter of the present disclosure, as shown in FIGS. 1 to 3, includes a cutter body A that releases rolled tape 10 accommodated therein to the outside and has a blade 120 that can cut the released tape 10.

The cutter body A may be formed in various shapes, and as shown in FIGS. 1 to 3, may have a structure for mounting rolled tape 10 therein and may have case shape that can come in contact with a taping-target object on the entirety or a portion of the bottom so that the tape 10 released and attached to the taping-target object can be pressed.

As a detailed example, the cutter body A may have an empty case shape being open on the bottom and a first side except for the front, in which a mount ring 151 on which the tape 10 can be fitted may be formed on a second side and an anti-separation ring 152 may be coupled to a side of the mount ring 151 to prevent inhibit the tape 10 fitted on the mount ring 151 from separating in one lateral direction.

The tape 10 accommodated inside the cutter body A can be released outside through the open bottom. A release hole 110 may be formed on the bottom of the cutter body A so that the release point can be specified. For example, the release hole 110, as shown in FIG. 3, may be formed between the bottom of the non-open front of the cutter body A and a release guide pin 140 disposed in the width direction of the cutter body A at a predetermined distance rearward from the bottom. Accordingly, the tape 10 fitted on and unwound from the mount ring 151 can be released outside through the release hole 110 defined by the bottom of the front of the cutter body A and the release guide pin 140. However, the release hole 110 may be formed in various shapes, depending on the shape of the cutter body A, and is not limited to the example described above.

The blade 120 provided at the cutter body A, as shown in FIGS. 1 to 3, may be disposed at the front end of the cutter body A, and not only may be integrated with the cutter body A, but may be formed detachably from the cutter body A so that it can be replaced. Further, though not shown, the blade 120 may be configured to be disposed inside the cutter body A and to protrude outside and cut the tape 10 by operation by a user.

In the present disclosure, the cutter body A has a taping guide 200 to be able to tape easily at once adjacent taping-target surfaces making a predetermined angle to each other. The predetermined angle means the angle between adjacent taping-target surfaces of a plurality of taping-target surfaces constituting a taping-target object. For example, when a taping-target object is a box, the angle between adjacent taping-target surfaces is generally 900 and it is assumed that the predetermined angle is 90° in the following description for the convenience of description, but it is not limited thereto and may mean an acute angle or an obtuse angle.

Figure 6:
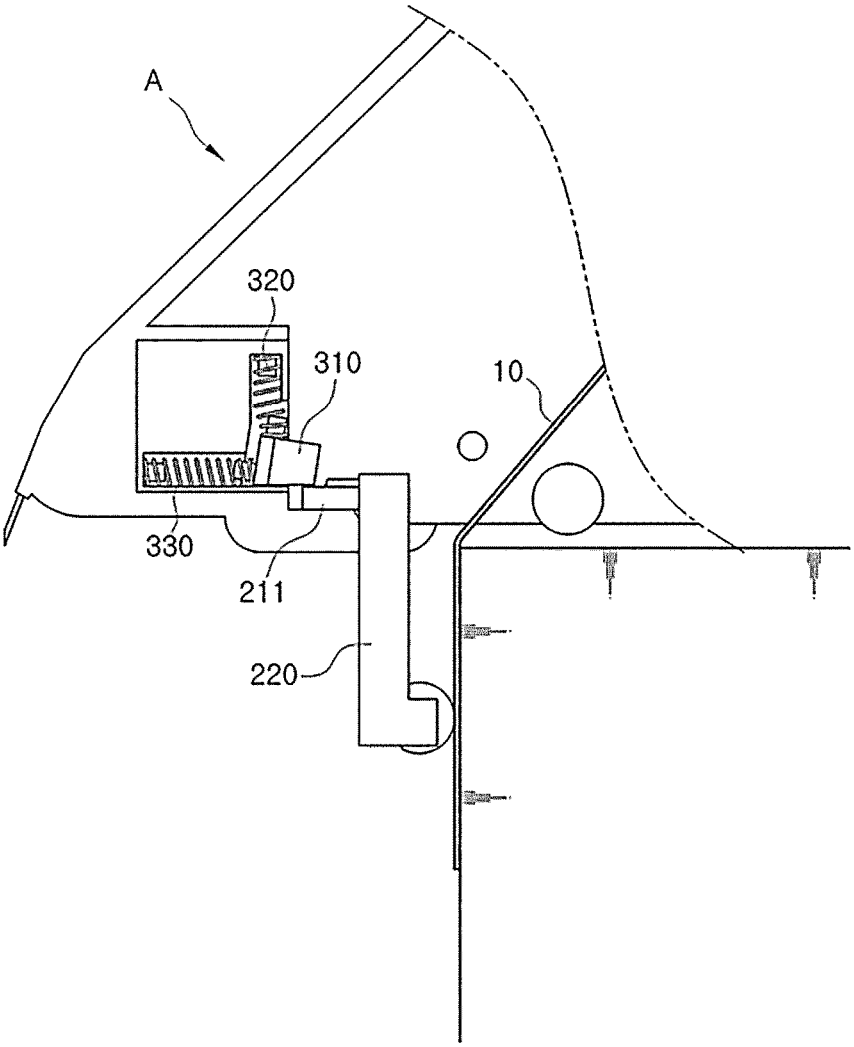
FIGS. 6 to 9 are exemplary views showing a process of taping adjacent taping-target surface making a predetermined angle to each other using a tape cutter of the present disclosure.

The taping guide 200, as shown in FIGS. 1 to 4, is disposed downward at the front side adjacent to the release hole 110, so the non-adhesive surface of the tape 10 that is released through the release hole 110 can come in contact with the rear of the taping guide 200. For example, as shown in FIG. 6, when the taping guide 200 is vertically positioned, the tape 10 released outside through the release hole 110 can be vertically released in contact with the rear of the taping guide 200.

The taping guide 200 disposed downward can be rotated forward and is configured to be held before it is rotated forward so that the tape 10 released outside and positioned on the rear of the taping guide can be attached to a taping-target surface. Holding of the taping guide 200 may be performed in various ways, and for example, the taping guide 200 may be configured to be elastically held.

To this end, the taping guide 200 may include a rotary shaft 210 and a taping guide member 220. As shown in FIGS. 1 to 5, the rotary shaft 210 may be disposed in the width direction of the cutter body A around the bottom adjacent to the release hole 110 inside the cutter body A, and the taping guide member 220 is coupled to the rotary shaft 210 and disposed downward and can be rotated forward together with the rotary shaft 210. As a detailed example, the taping guide member 220 is formed in a U-shape to be open upward and can be coupled at both ends to both ends of the rotary shaft 210 protruding from both sides of the cutter body A.

A locking protrusion 211 protruding in a direction in which it does not interfere with rotation of the taping guide member 220, that is, protruding forward may be formed on the rotary shaft 210. When a force that rotates forward the taping guide member 220 is applied, the holding protrusion 211 is locked, and then when a force over a predetermined level is applied in the same direction, the holding protrusion 211 can be unlocked.

To this end, for example, the cutter body A may include a holding unit 300 therein that elastically locks the locking protrusion 211 therein. The holding unit 300 may include a holder 310 that is, as shown in FIGS. 1 to 5, disposed such that an end portion thereof is positioned over an end portion of the locking protrusion 211 for elastic holding when the taping guide member 220 is positioned downward.

Figure 4:
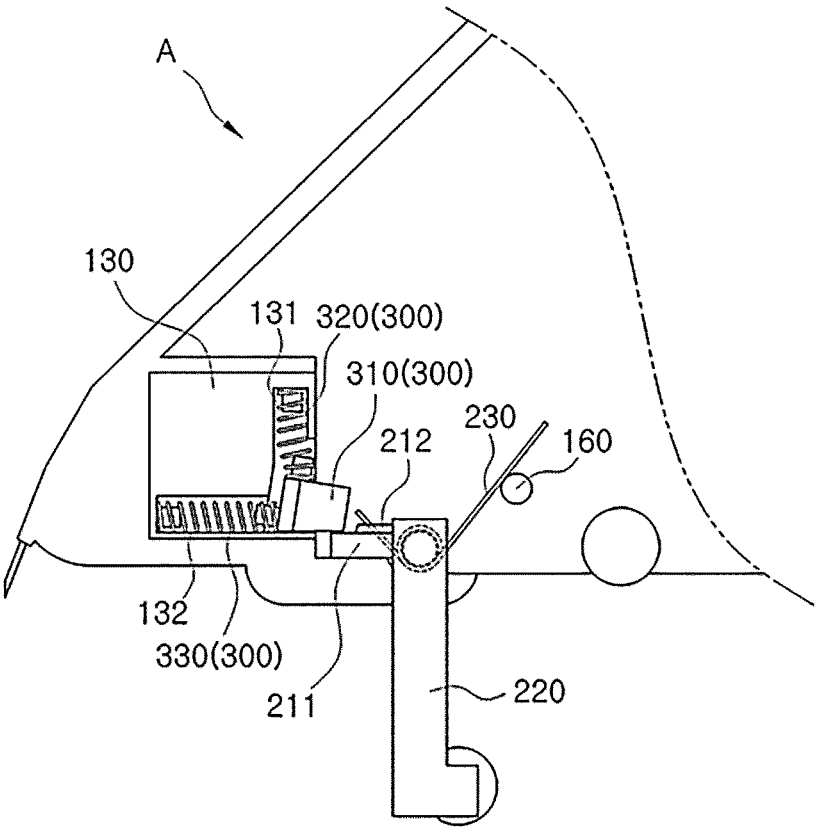
FIG. 4 is a partial enlarged view showing the installation structure of a holder mount, a taping guide, and a holding unit that are applied to a tape cutter of the present disclosure.

As a detailed example, as shown in FIG. 4, a holder mount 130 for installing the holder 310 may be provided inside the front of the cutter body A. The holder 310 is positioned and the holder mount 130 and faces rear, so the other portion excluding the front can protrude from the holder mount 130. A guide flange 311 may be formed on both sides of the front of the holder 310 so that the holder 310 in the holder mount 130 can be moved up and down without being pulled out, and movement passages 133 in which the guide flanges 311 can be accommodated may be formed in the up-down direction inside the holder mount 130.

Figure 5:
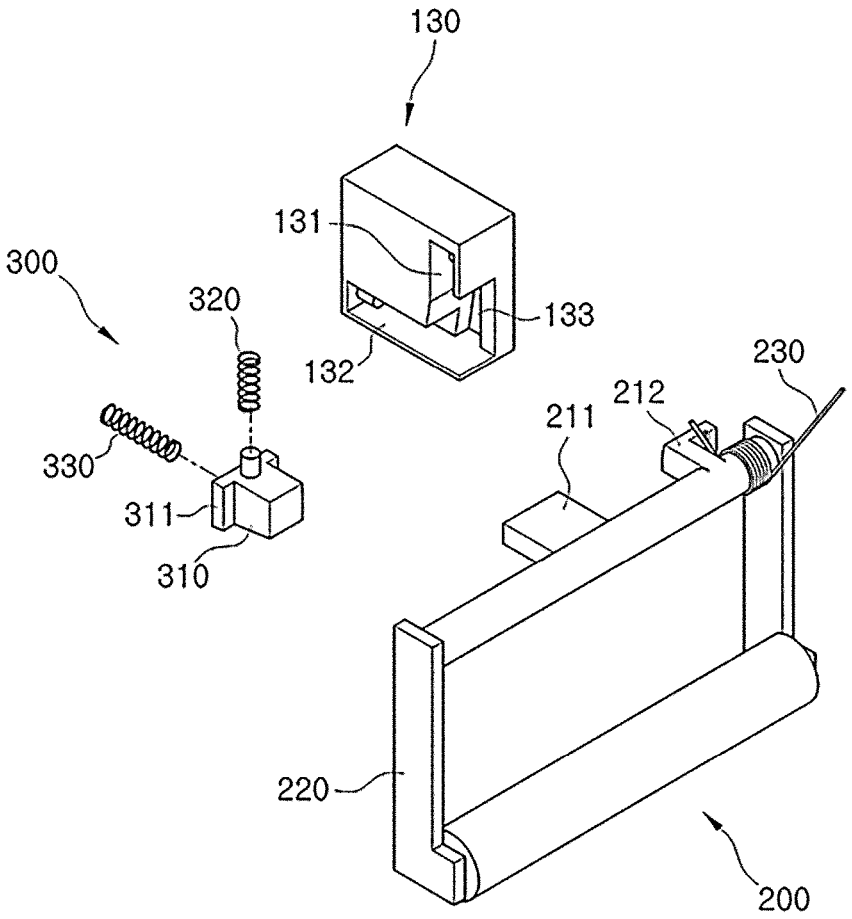
FIG. 5 is an exploded perspective view showing the structures of the holder mount, the taping guide, and the holding unit that are applied to a tape cutter of the present disclosure.

The holding unit 300 may include a first holding spring 320 and a second holding spring 330 that apply elasticity to the holder 310 so that the locking protrusion 211 can be elastically locked through the holder 310. For example, as shown in FIGS. 4 and 5, a first spring installation channel 131 connected with the movement passages 133 may be formed between the movement passages 133 in which the guide flanges 311 on both sides of the holder 310 may be formed in the holder mount 130, and a first holding spring 320 may be provided such that a first end thereof is in contact with the top of the first spring installation channel 131 and a second end thereof is in contact with the top of the holder 310. Further, a second spring installation channel 132 may be formed forward from the bottom of the first spring installation channel 131 in the holder mount 130, and a second holding spring 330 may be provided such that a first end thereof is in contact with the front of the second spring installation channel 132 and a second end thereof is in contact with the front of the holder 310. In this configuration, the holder 310 should be able to move forward and backward so that elasticity of the second holding spring 330 can act, so the first spring installation channel 131 and the movement passages 133 may be formed such that the lower portion thereof are wider in the front-rear direction than the other portion. For example, the lower portions of the first spring installation channel 131 and the movement passages 133 may be formed such that the width in the front-rear direction gradually increases downward.

Accordingly, elasticity is applied downward to the holder 310 by the first holding spring 320 and elasticity is applied rearward to the holder 310 by the second holding spring 330. Since the guide flanges 311 of the holder 310 to which elasticity is applied by the first holding spring 320 and the second holding spring 330, as described above, are accommodated in the movement passages 133, the holder 310 is not separated out of the holder mount 130.

The process in which the locking protrusion 211 is elastically locked and unlocked in the present disclosure described above is described. As shown in FIG. 6, the end portion of the holder 310 protruding from the holder mount 130 is positioned adjacent o and over the end portion of the locking protrusion 211 when the taping guide member 220 is positioned downward. When a force that rotates the taping guide 200 forward is applied, the holder 310 is not moved until a force larger than the elasticity of the first holding spring 320 and the second holding spring 330 is applied, so the locking protrusion 211 is elastically locked.

Figure 7:
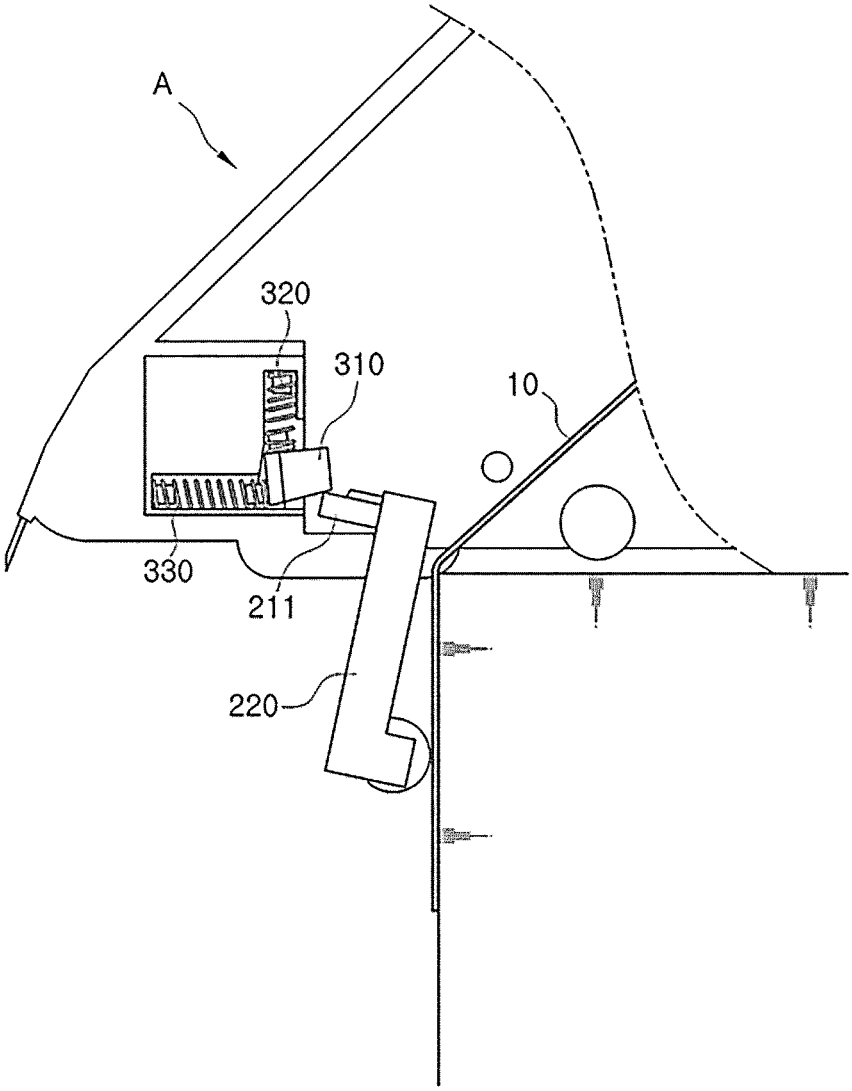
Figure 8:
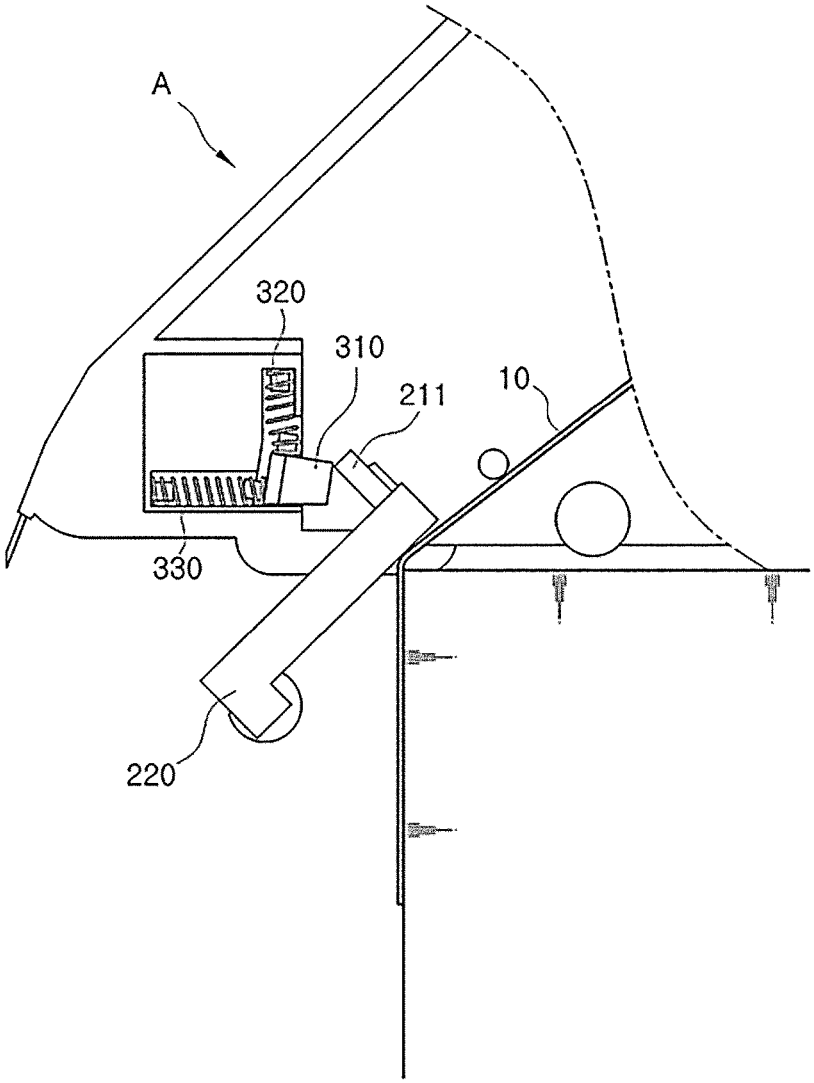
Figure 9:
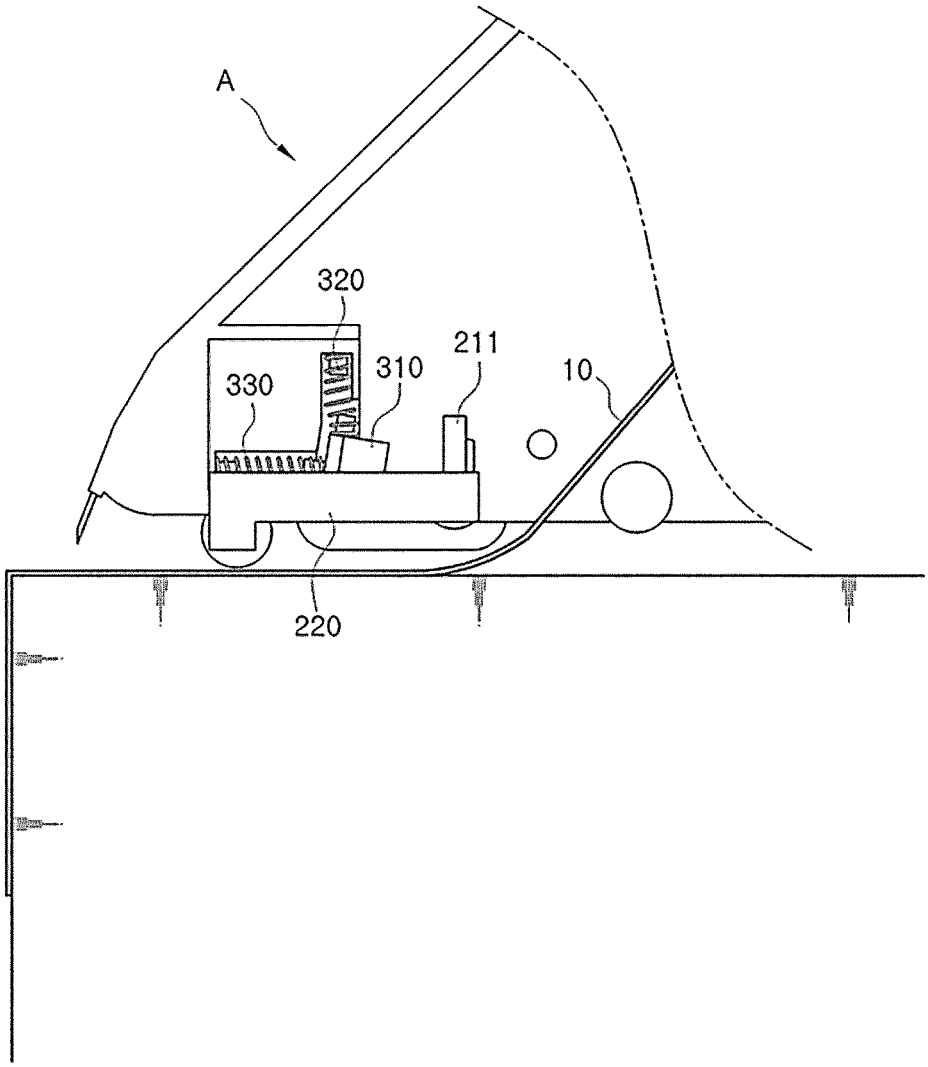

Thereafter, when a force larger than the elasticity of the first holding spring 320 and the second holding spring 330 is applied, as shown in FIGS. 7 and 8, the end portion of the locking protrusion 211 pushes up the end portion of the holder 310 while pushing forward the end portion of the holder 310, whereby the locking protrusion 211 is unlocked from the holder 310. The bottom of the end portion of the holder 310 may be formed to be inclined upward toward the rear so that the locking protrusion 211 can be easily unlocked from the holder 310. That is, when a force over a predetermined level is applied, the end portion of the locking protrusion 211 positioned under the holder 310 slides on the inclined bottom of the end portion of the holder 310 while pushing up the end portion of the holder 310, whereby the locking protrusion 211 can be unlocked from the holder 310. Accordingly, as the locking protrusion 211 elastically locked to the holder 310 is unlocked, the taping guide 200 is rotated forward, as shown in FIG. 9.

In order that the taping guide 200 rotated forward can press the tape 10 attached to a taping-target surface, the portion, where the forwardly rotated taping guide 200 is positioned, of the bottom of the front of the cutter body A may be recessed upward. Accordingly, the taping guide 200 rotated forward and accommodated in the recessed portion of the bottom of the front of the cutter body A presses the tape 10 attached to a taping-target surface together with the non-recessed portion of the front of the cutter body A.

That is, according to the present disclosure, as shown in FIGS. 6 to 9, for adjacent taping-target surfaces making a predetermined angle to each other, when the cutter body A is moved to move over a second taping-target surface with the taping guide 200, which is positioned downward, positioned close to a first taping-target surface, the taping guide 200 is held, so the tape 10 is attached to the first taping-target surface. Further, as the cutter body A keeps being moved, the taping guide 200 is rotated forward, so the tape 10 is attached to the second taping-target surface without interference by the taping guide 200. Accordingly, a worker can tape adjacent taping-target surfaces even without turning a taping-target object or bending his/her arm, so it is possible to inhibit injuries of a worker and improve work efficiency.

Meanwhile, the taping guide 200 can be returned to the initial position by elasticity after rotated forward so that the taping guide 200 rotated forward can display its function again.

For example, the taping guide 200 can be elastically returned by a return spring 230 disposed on the rotary shaft 210, as shown in FIGS. 4 and 5, and, in this configuration, the return spring 230 may be a torsion spring. In order that elasticity is applied by the return spring 230 that is a torsion spring, the return spring 230 may be wound on the rotary shaft 210 close to the second side of the cutter body A. Further, a first end protruding from the wound part of the return spring 230 may be fixed by a first spring fixing protrusion 212 protruding from the rotary shaft 210 and a second end protruding from the wound part may be fixed by a second spring fixing protrusion 160 protruding inward from the second side of the cutter body A.

Therefore, when the force pressing the tape 10 attached to a taping-target surface is removed, the taping guide 200 rotated forward is rotated rearward by elasticity of the return spring 230, whereby the taping guide 200 can be returned to be positioned downward.

Sequence List Free Text

[Description of Reference Numerals]

A: cutter body
10: tape
110: release hole
120: blade
130: holdeer mount
131: first spring instllation channel
132: second spring instllation channel
133: movement passage
140: release guide pin
151: mount ring
152: anti-separation ring
160: second spring fixing protrusion
200: taping guide
210: rotary shaft
211: locking protrusion
212: first spring fixing protrusion
220: taping guide member
230: return spring
300: holding unit
310: holder
311: guide flange
320: first holding spring
330: second holding spring

The invention claimed is:

1. A tape cutter, comprising a cutter body configured to release rolled tape accommodated therein to pass outside of the cutter body through a release hole formed on a bottom side of the cutter body, and configured to be able to cut the released tape by a blade, wherein the cutter body comprises a taping guide disposed downward at a front side of the cutter body adjacent to the release hole, wherein the taping guide is configured to make the tape be released with a non-adhesive surface of the tape in contact with a rear of the taping guide, wherein the taping guide is configured to rotate forward, the taping guide comprising a rotary shaft disposed in a width direction inside the cutter body, and a taping guide member coupled to rotate with the rotary shaft and disposed downward, wherein a locking protrusion protruding in a direction in which the locking protrusion does not interfere with rotation of the taping guide member is formed on the rotary shaft, wherein the cutter body comprises a holding unit therein configured to elastically lock the locking protrusion, the holding unit comprising a holder disposed such that an end portion of the holder, in a direction of the release hole, is positioned over an end portion of the locking protrusion and configured so when a force that rotates forward the taping guide member is applied, the locking protrusion is elastically locked by the holder, and then when a force over a predetermined level is applied, the locking protrusion is unlocked from the holder, wherein an elastic holding by the holder provides a resilient resistance against forward rotation of the taping guide such that the taping guide is held in a downward position until a force exceeding the elastic holding by the holder is applied, and wherein the blade is disposed at a front end of the cutter body forward of the taping guide when the taping guide is rotated forward.

2. The tape cutter of claim 1, wherein a bottom of the end portion of the holder is configured to be inclined upward toward a rear of the cutter body, such that when a force over a predetermined level is applied, the locking protrusion slides along the inclined bottom of the end portion of the holder to unlock from the holder.

3. The tape cutter of claim 1, wherein the taping guide is returned to an initial position by elasticity after being rotated forward.

* * * * *